US006357553B1

(12) United States Patent
Vialonga

(10) Patent No.: US 6,357,553 B1
(45) Date of Patent: Mar. 19, 2002

(54) ELEVATOR CAR ACCESS KEY SWITCH

(75) Inventor: Edward Vialonga, Bergenfield, NJ (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/657,650

(22) Filed: Sep. 7, 2000

(51) Int. Cl.[7] ..... B66B 1/18
(52) U.S. Cl. ..... 187/385; 187/391
(58) Field of Search ..... 187/380, 384, 187/385, 388, 389, 391, 395

(56) References Cited

U.S. PATENT DOCUMENTS 5,476,157 A * 12/1995 Todaro ..... 187/280
5,616,894 A * 4/1997 Nieminem et al. ..... 187/247
5,740,888 A * 4/1998 Aulanko et al. ..... 187/336
5,817,994 A * 10/1998 Fried et al. ..... 187/391
6,173,814 B1 * 1/2001 Herkel et al. ..... 187/288
6,223,861 B1 * 5/2001 Sanservero ..... 187/316
6,230,845 B1 * 5/2001 Yamakawa et al. ..... 187/391

* cited by examiner

*Primary Examiner*—Jonathan Salata
(74) *Attorney, Agent, or Firm*—Carlson, Gaskey & Olds

(57) ABSTRACT

A device for providing access to an elevator cab includes a key access switch that is useful to generate at least one signal indicating a desire to move a specified elevator cab to a specified landing within a building. A controller communicates with the switch and responsively causes the specified elevator cab to be moved to the specified landing. The switch preferably operates in a first mode for calling the elevator cab to the specified landing. The switch preferably also operates in a second mode for selectively adjusting a position of the elevator cab within a hoistway during a maintenance procedure.

13 Claims, 2 Drawing Sheets

ELEVATOR CAR ACCESS KEY SWITCH

BACKGROUND OF THE INVENTION

This invention generally relates to elevator control systems. More particularly, this invention relates to a key access device for directing an elevator cab to a specific landing.

Most elevator cabs travel within a hoistway between landings at different levels in a building. Typical passengers obtain access to the elevator cab by using a hall button. When there are multiple elevator cabs within multiple hoistways within a building, activation of a hall button typically results in at least one elevator cab arriving at the landing to allow a passenger access.

There are also times when a technician needs access to an elevator cab to perform maintenance or repair. For these instances, key access switches have been used that allow a technician to gain access to the cab. A difficulty associated with conventional key access switches is that they only control cab position after the technician has access to the cab at a desired landing. The technician must rely on the passenger hall buttons, which are not specifically dedicated to a particular elevator cab, to get the desired cab to a landing. In buildings where there are multiple hoistways and multiple cabs, a technician may not obtain access to the desired cab until multiple attempts are made because the elevator system randomly sends a cab to the landing where the technician desires access. This proves frustrating where multiple hoistways are present and the technician needs access to a particular elevator cab.

This invention addresses the need for an improved access system by providing a key access switch that provides the desired results each time upon a first try.

SUMMARY OF THE INVENTION

In general terms, this invention is a device for providing specific access to an elevator cab within a building regardless of the number of hoistways or elevator cabs that are present. The inventive device includes a switch that is selectively activated to generate a signal indicating a desire for access to a specific elevator cab at a specific landing. A controller communicates with the switch and directs the appropriate elevator cab to the appropriate landing.

The inventive switch also includes the ability to operate in an inspection mode to selectively move the elevator cab up or down a selected amount within the hoistway during a maintenance procedure.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
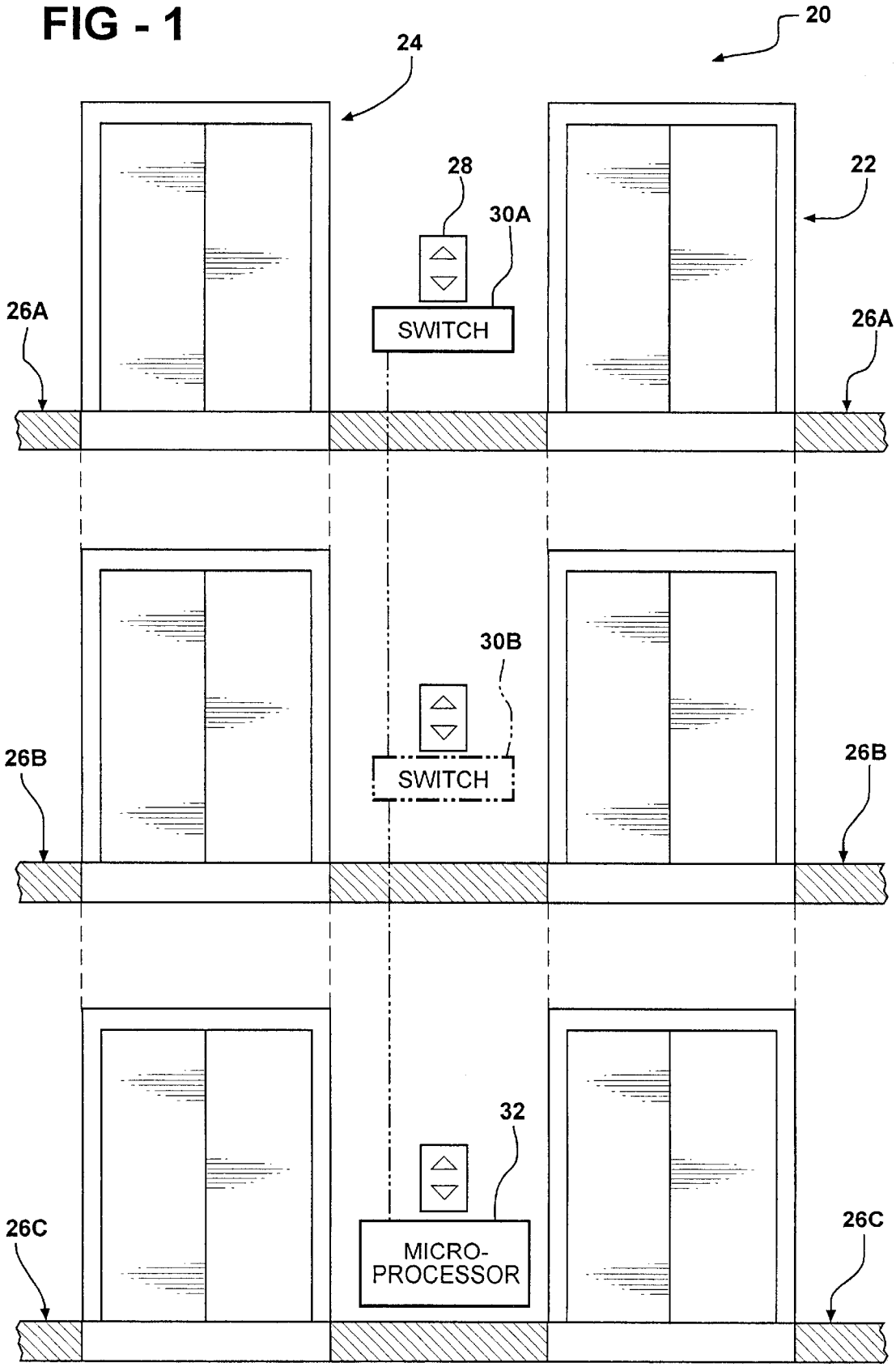
FIG. 1 is a diagrammatic illustration of an elevator system designed according to this invention.

FIG. 1 illustrates an elevator system 20 that includes a plurality of elevator cabs 22 and 24. Each elevator cab travels within a hoistway (not illustrated) in a conventional manner. The elevator cabs travel between landings at different levels in a building, for example. A landing 26 is illustrated in FIG. 1 for discussion purposes.

When a passenger desires access to an elevator cab, conventional hall buttons 28 can be used. A signal generated by activation of the hall buttons 28 operates to bring an elevator cab to the landing 26 in a conventional manner.

A key access switch 30 allows a technician to obtain access to a selected one of the elevator cabs at the landing 26. The key access switch 30 communicates with a controller 32, which responsively activates a drive mechanism for the appropriate elevator cab to bring it to the desired landing. Although only one landing 26, which represents one level in a building, is illustrated in FIG. 1, it is within the scope of this invention to include a key access switch 30 at multiple levels within a building. For example, one system designed according to this invention includes a key access switch at the uppermost and lowermost levels within the building.

Figure 2:
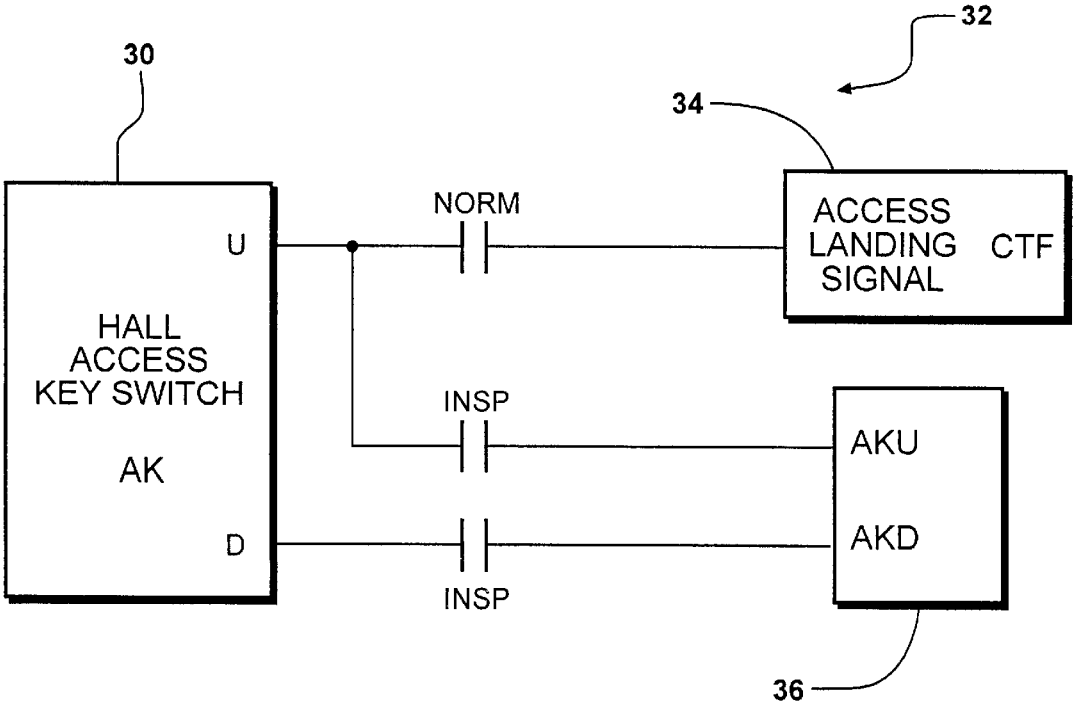
FIG. 2 schematically illustrates a switching device designed according to this invention.

The key access switch 30 preferably is operable by an approved technician using a conventional key to obtain access to the switch. The switch 30 preferably operates in at least two modes. A first mode provides the access landing signal to the controller 32. A first portion 34 of the controller 32 is schematically illustrated in FIG. 2 as containing the software module that processes the signals requesting an elevator cab at a particular landing. A significant advantage of this invention is that the controller 32 directs only a specified elevator cab to a specified landing responsive to a signal from the switch 30. In one example, a switch 30 is dedicated to each hoistway or each elevator cab.

A second mode of operation for the switch is useful during a maintenance procedure. This mode is referred to as the inspection mode. When the access switch is used in the inspection mode, it allows the technician to adjust the position of the cab within the hoistway by generating signals indicating a desire to move the cab up or down, depending on the needs of a particular situation. FIG. 2 schematically illustrates a software module 36 within the controller 32 that processes signals from the switch 30 in the inspection mode.

Separate software modules 34 and 36 are illustrated in FIG. 2 for discussion purposes only. Those skilled in the art who have the benefit of this description will be able to realize a controller 32 from commercially available components, custom designed circuitry or customized software. Given this description, those skilled in the art will be able to develop the necessary software module or modules to accomplish the results described in this specification.

The preceding description is exemplary rather than limiting in nature. Variations and modifications to the disclosed examples may become apparent to those skilled in the art that do not necessarily depart from the scope or spirit of this invention. The scope of legal protection given to this invention can only be determined by studying the following claims.

What is claimed is:

1. A device for controlling an elevator system having a plurality of elevator cabs that are moveable between landings, comprising:

a switch that is selectively activated to generate a signal indicating a desire to access a specified one of the cabs at a specified one of the landings;

a controller that is responsive to a signal from said switch and causes the specified cab to move to the specified landing.

2. The device of claim 1 wherein the switch is dedicated to a single one of the elevator cabs.

3. The device of claim 1 wherein the switch generates multiple signals, each signal corresponding to a specified one of the cabs.

4. The device of claim 1 wherein the switch operates in two modes, a first mode including generating a signal indicating a desire to access the specified cab at the specified landing and a second mode including generating signals to cause the elevator cab position to be adjusted.

5. An elevator system, comprising:

a plurality of elevator cabs that are moveable within respective hoistways between a plurality of landings;

a switch that is selectively activated to generate a signal indicating a desire to move a specified one of the elevator cabs to a specified one of the landings; and a controller that is responsive to a signal from the switch to move the specified elevator cab to the specified landing.

6. The system of claim 5, including a plurality of switches, each switch being dedicated to a respective one of the elevator cabs.

7. The system of claim 5, including a plurality of switches, each switch corresponding to a different one of the landings.

8. The system of claim 5, wherein the switch generates multiple signals, each of the signals corresponding to a respective one of the elevator cabs and indicating a desire to move the respective cabs to a specified landing.

9. The system of claim 5, wherein the switch operates in two modes, a first one of the modes including generating a signal indicating a desire to move the specified cab to the specified landing and a second mode including generating signals indicating a desire to adjust a position of the elevator cab within the hoistway.

10. The system of claim 5, including a plurality of switches and a corresponding plurality of controllers, each said switch and each said corresponding controller being dedicated to a specified one of the elevator cabs.

11. The device of claim 1, wherein the switch is mounted in a fixed position near the specified landing.

12. The system of claim 5, wherein the switch is physically mounted near the specified one of the landings.

13. The system of claim 7, wherein each switch is physically mounted near a respective landing.

* * * * *